US006018876A

United States Patent [19]

Hodges et al.

[11] Patent Number: 6,018,876

[45] Date of Patent: Feb. 1, 2000

[54] SPIRAL SLICER FOR WEINER TYPE PRODUCTS

[76] Inventors: Ralph Hodges, 2907 Shelter Island Dr. #105-205, San Diego, Calif. 92106; Clarence Steinback, 5508 McGuire Rd., Edina, Minn. 55439

[21] Appl. No.: 09/140,991

[22] Filed: Aug. 27, 1998

[51] Int. Cl.[7] ..... B26B 3/00

[52] U.S. Cl. ..... 30/279.2; 30/278; 83/880; 83/882

[58] Field of Search ..... 30/278, 279.2, 30/279.6, 289, 90.1, 347, 124; 82/1.11; 83/880, 882

[56] References Cited

U.S. PATENT DOCUMENTS

| | | | |
|---|---|---|---|
| D. 329,967 | 10/1992 | Kennedy . | |
| 3,940,842 | 3/1976 | Perrinelle et al. | 30/289 X |
| 3,999,293 | 12/1976 | Zubrycki . | |
| 4,071,950 | 2/1978 | Telesio . | |
| 4,976,029 | 12/1990 | Kennedy . | |
| 5,067,241 | 11/1991 | Goodman . | |
| 5,746,106 | 5/1998 | Hodges . | |

FOREIGN PATENT DOCUMENTS

| | | | |
|---|---|---|---|
| 219112 | 1/1962 | Austria | 30/90.1 |

*Primary Examiner*—Douglas D. Watts
*Attorney, Agent, or Firm*—Nydegger & Associates

[57] ABSTRACT

A tool for incising a cylindrical shaped meat product with superficial spiral cuts includes a tubular shaped base which is formed with a lumen and which has an inner surface and an outer surface. A plurality of cutting blades are mounted on the base to protrude inwardly from the inner surface. Further, the blades are inclined at an angle α relative to the longitudinal axis of the tool. A grip can be formed on the outer surface of the tool. In its operation, the meat product, such as a hot dog, is inserted into the lumen of the tool, and rotated while it is being advanced through the lumen. The result is a pattern of spiral incisions which are cut into the meat product and which extend along the length of the product.

9 Claims, 2 Drawing Sheets

SPIRAL SLICER FOR WEINER TYPE PRODUCTS

FIELD OF THE INVENTION

The present invention pertains generally to cutting tools. More particularly, the present invention pertains to tools for cutting meat products. The present invention is particularly, but not exclusively, useful as a tool for superficially cutting a hot dog type meat product with a plurality of spiral incisions that extend along the length of the meat product.

BACKGROUND OF THE INVENTION

Many commercially available meat products are prepared and packaged by the manufacturer to be cooked and eaten by the consumer, without the need for further preparation or processing. While this may be convenient for the consumer who is rushed or unmindful of the aesthetic aspects of a meal, it is also a fact that many consumers also desire to serve, or have their meals served, in a variety of different presentations. Insofar as meat products are concerned, the presentation will depend not only on how the meat product has been cooked, but on how it has been cut, as well.

For the preparation of cylindrical shaped meat products, such as hot dogs, wieners and sausages, cutting can basically be accomplished in either of two ways. First, the meat product can be cut into pieces or slices. Meat products in this first category include cold cuts, such as bologna and pepperoni. Second, and heretofore not so common, the meat product can be superficially incised with unique multiple superficial cuts to at least partially expose the interior of the sausage or hot dog. This can also produce interesting, entertaining and functional patterns on the meat product. If meat products in this second category are superficially incised prior to cooking, several practical benefits in addition to an added aesthetic value can be realized. Specifically, these benefits will include the more even and thorough cooking of the meat product that is made possible by the superficial incisions. Further, with the more even cooking there is more extensive killing of bacteria and, with the superficial incisions, more excess fat is released while the meat product cooks. Additionally, after the meat product has been properly cooked, the superficial incisions provide a more textured surface for holding various toppings on the meat product. In the case of hot dogs, when they are eaten with hot dog buns, the superficial incisions will help hold the meat product on the bun. Perhaps most importantly, the discontinuities provided by the superficial incisions make it easier for young children and elderly persons to bite into and chew the cooked meat product. Finally, due to the increased flexibility afforded a cooked meat product with superficial incisions as indicated for the present invention, the cooked meat product can be easily straightened, or otherwise configured, to make the meat product more easily held in a bun.

If done by hand, the cutting of superficial incisions into the surface of a hot dog or another similar type meat product can be quite time consuming. This is particularly so if many hot dogs are involved, and if care is taken to insure the incisions are cut to a uniform depth into the meat product. Further, even simple superficial incisions into the surface of a hot dog may be difficult to execute. This difficulty is only increased if fanciful and precise patterns are desired.

In light of the above it is an object of the present invention to provide a tool for incising the surface of a cylindrical shaped meat product which cuts the meat product to a substantially uniform depth along the length of the incision.

It is another object of the present invention to provide a tool for incising the surface of a cylindrical shaped meat product which cuts the meat product with a fanciful and precise pattern. Still another object of the present invention is to provide a tool for incising the surface of a cylindrical shaped meat product to expose the interior of the meat product for more even and thorough cooking. Yet another object of the present invention is to provide a tool for incising the surface of a cylindrical shaped meat product which is easy to use, relatively simple to manufacture, and comparatively cost effective.

SUMMARY OF THE PREFERRED EMBODIMENTS

A tool for incising a cylindrical shaped meat product includes a tubular shaped base member which generally defines a longitudinal axis and which is formed with a lumen that extends along the axis. Additionally, the base member has an outer surface which is formed with a grip that facilitates holding the tool during its use and operation. The base member of the tool also has an inner surface which surrounds and defines the lumen.

A plurality of blades are mounted on the inner surface of the base to protrude inwardly therefrom toward the longitudinal axis of the tool. In the preferred embodiment of the present invention, three straight blades are mounted around the lumen of the base member, and they are radially separated from each by approximately one hundred and twenty degrees. Further, each blade is inclined relative to the longitudinal axis of the tool by an angle, $\alpha$, which is in a range of approximately twenty to sixty degrees (20°–60°). Still further, the blades are located approximately midway through the lumen for safety purposes. Specifically, the blades are located far enough inside the base member to avoid accidental access to the sharp blades. Preferably, the base member is made of plastic and the blades are made of metal.

In the operation of the incising tool of the present invention, a meat product, such as a hot dog, is first inserted into the lumen of the tool until the meat product comes into contact with the blades. The meat product is then urged and guided through the lumen of the tool. As the meat product is advanced through the tool, it is rotated relative to the tool to incise the surface of the meat product. The result is a pattern of helical spiral cuts which extend along the length of the meat product.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
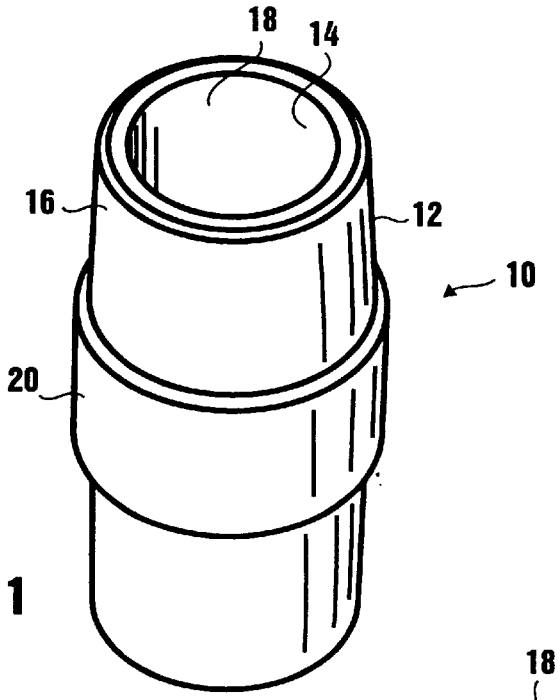
FIG. 1 is frontal perspective view of the incising tool of the present invention.

Referring initially to FIG. 1, an incising tool in accordance with the present invention is shown and generally designated 10. As shown in FIG. 1, the tool 10 includes a base member 12 which is tubular shaped and preferably made of plastic. With its tubular configuration, the tool 10 has an inner surface 14 and an outer surface 16. More specifically, the inner surface 14 of the tool 10 surrounds and defines a lumen 18 which extends through the tool 10 along its entire length. If desired, the outer surface 16 of the tool 10 can be formed with a grip 20 which will facilitate the holding of the tool 10 during its use and operation.

Figure 2:
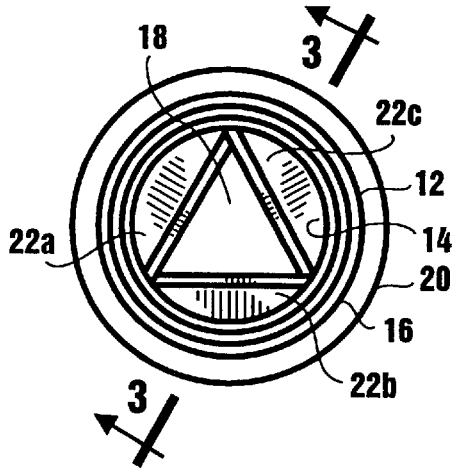
FIG. 2 is a top view of the incising tool of the present invention showing cutting blades mounted in the lumen of the tool's base member.

As best seen in FIG. 2, the incising tool 10 of the present invention includes a plurality of metal cutting blades 22. Although the incising tool 10 will preferably have three blades 22, such as the blades 22*a–c* shown in the Figures, it will be appreciated that more or fewer blades 22 can be used as desired. For the preferred embodiment of the incising tool 10, however, there will be three blades 22.

Figure 3:
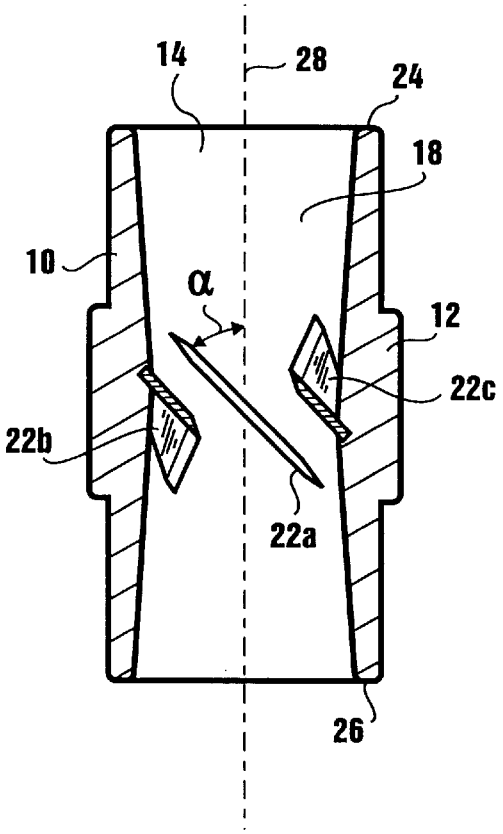
FIG. 3 is an elevational cross-section view of the incising tool as seen along the line 3—3 in FIG. 2.

By cross referencing FIGS. 2 and 3 it will be appreciated that the blades 22 are mounted on the inner surface 14 of the base member 12 and that they are located approximately midway between the open ends 24 and 26 of the base member 12. Furthermore, the blades 22 are mounted to protrude inwardly into the lumen 18. As so mounted, for the three-blade embodiment disclosed herein, the blades 22*a–c* are radially oriented at approximately one hundred and twenty degree intervals. Additionally, with specific reference to FIG. 3, it will be seen that the base member 12 defines a longitudinal axis 28, and that all of the blades 22*a–c* are inclined at an angle, $\alpha$, relative to the axis 28. For purposes of the present invention, the angle $\alpha$ is preferably in a range that is between approximately twenty and sixty degrees (20°–60°).

Figure 4:
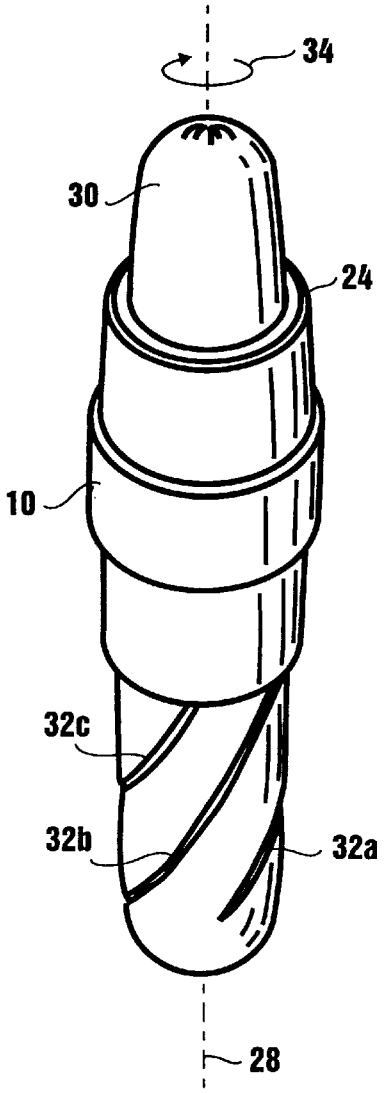
FIG. 4 is a perspective view of the incising tool of the present invention shown in its operation for cutting spiral incisions into the surface of a meat product.

In the operation of the incising tool 10 of the present invention, a hot dog 30 is inserted into the open end 24 of the base member 12. Initially, the hot dog is advanced into the base member 12 until it comes into contact with the blades 22*a–c*. Upon contacting the blades 22*a–c*, the hot dog 30 is then rotated about the axis 28 in a direction indicated by the arrow 34. By urging and guiding the hot dog 30 into the tool 10 along a path that is generally defined by the axis 28, and by simultaneously rotating the hot dog 30 relative to the tool 10 as it is being advanced along the path, superficial incisions 32 are cut into the surface of the hot dog 30 by the blades 22*a–c*. The result, as shown in FIG. 4, are a plurality of superficial incisions 32*a–c*. More specifically, each of the blades 22*a–c* cuts one of the respective incision 32*a–c*. Importantly, all of the incisions 32*a–c* will have a depth which is determined by the size of the respective blade 2*a–c*, and all of the incisions 32*a–c* will extend as a helix in a precise spiral pattern along the length of the hot dog 30.

It will be appreciated by the skilled artisan that the sizes of the blades 22*a–c* and the size of the lumen 18, as well as the length of the base member 12, can be varied as desired. Consequently, the size of the meat product to be incised can be varied and the depth of the incisions 32 into the meat product can be varied as desired.

Figure 5:
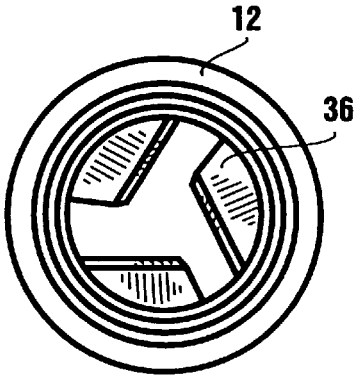
FIG. 5 is a top view of the incising tool of the present invention showing an alternate embodiment for the cutting blades mounted in the lumen of the tool's base member.
Figure 6:
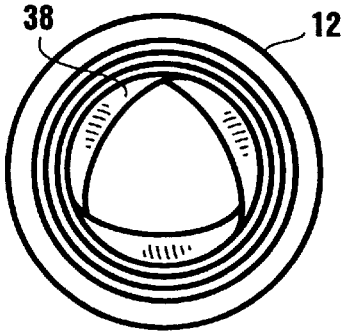
FIG. 6 is a top view of the incising tool of the present invention showing yet another embodiment for the cutting blades mounted in the lumen of the tool's base member.

Alternate embodiments for the present invention will be seen with reference to FIGS. 5 and 6. Specifically, the alternate embodiments incorporate variations of the blades 22. In FIG. 5, it will be seen that the incising tool 10 can incorporate shortened blades 36. In FIG. 6, it will be seen that the incising tool 10 can incorporate curved blades 38. It will thus be appreciated that various arrangements of blades 22, 36 or 38 can be employed and that various numbers of blades can be used in any one incising tool 10.

While the particular invention as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. An incising tool which comprises:

a tubular shaped base formed with a lumen for receiving a cylindrical shaped meat product therethrough, said base having a first end and a second end, and having an inner surface and an outer surface, said base also defining a longitudinal axis; and at least three straight blades mounted on said base to protrude from said inner surface toward said axis, said blades being inclined relative to said longitudinal axis to incise the meat product as the meat product passes through said lumen wherein each said blade is mounted on said base approximately midway between said first end of said base and said second end of said base, and wherein each said blade has a first end and a second end and each said blade is inclined at an angle $\alpha$ relative to said longitudinal axis with said first end of said blade being closer to said first end of said base than said second end of said blade, and said second end of said blade being closer to said second end of said base than said first end.

2. An incising tool as recited in claim 1 wherein said angle $\alpha$ is in a range of approximately twenty to sixty degrees (20°–60°).

3. An incising tool as recited in claim 1 further comprising a grip mounted on said outer surface of said base.

4. An incising tool as recited in claim 1 wherein said base is made of plastic.

5. An incising tool as recited in claim 1 wherein said blades are made of metal.

6. An incising tool as recited in claim 1 wherein said meat product is a hot dog.

7. A manually operable tool for incising the surface of a tubular shaped meat product, the meat product substantially defining a longitudinal axis and said tool comprising:

a tubular shaped base formed with a lumen for receiving the meat product therethrough, said base having a first end and a second end, and having an inner surface and an outer surface, said base also defining a longitudinal axis for guiding the meat product along a coaxial path;

three straight blades mounted on said base approximately midway between said first end of said base and said second end of said base wherein each said blade has a first end and a second end and each said blade is inclined at an angle $\alpha$ with said first end of said blade being closer to said first end of said base than said second end of said blade, and said second end of said blade being closer to said second end of said base than said first end and wherein said angle $\alpha$ is in a range of approximately twenty to sixty degrees (20°–60°) for cutting spiral incisions into the surface of the meat product as the meat product is advanced along said path, said blades being fixedly mounted on said base for rotation therewith as said tool is rotated relative to the meat product; and a grip mounted on said outer surface of said base, and wherein said base is made of plastic, and further wherein said blades are made of metal.

8. A method for incising the surface of a tubular shaped meat product which comprises the steps of:

providing a tool having a tubular shaped base formed with a lumen for receiving the meat product therethrough, said base having a first end and a second end, and having an inner surface and an outer surface, said base also defining a longitudinal axis, said tool also having three blades mounted on said base to protrude from said inner surface toward said longitudinal axis, said blades being inclined relative to said longitudinal axis to incise the meat product as the meat product passes through said lumen wherein each said blade is mounted on said base approximately midway between said first end of said base and said second end of said base, and wherein each said blade has a first end and a second end and each said blade is inclined at an angle $\alpha$ relative to said longitudinal axis with said first end of said blade being closer to said first end of said base than said second end of said blade, and said second end of said blade being closer to said second end of said base than said first end;

inserting the meat product into the lumen of the tool;

guiding the meat product during advancement of the meat product through the lumen of the tool; and rotating the meat product relative to said tool during said guiding step to incise the surface of the meat product with a spiral cut.

9. A method as recited in claim 8 further comprising the step of gripping the tool during said guiding and rotating steps.

* * * * *